US005913464A

United States Patent [19]

Häberlein

[11] Patent Number: 5,913,464

[45] Date of Patent: Jun. 22, 1999

[54] BELT ARRANGEMENT FOR CARRYING A HAND-HELD WORKING TOOL

[75] Inventor: Jürgen Häberlein, Murrhardt, Germany

[73] Assignee: Andreas Stihl AG & Co., Waiblingen, Germany

[21] Appl. No.: 08/919,383

[22] Filed: Aug. 28, 1997

[30] Foreign Application Priority Data

Aug. 28, 1996 [DE] Germany ..... 196 34 670

[51] Int. Cl.[6] ..... A45F 3/04

[52] U.S. Cl. ..... 224/259; 224/268; 224/907; 224/262

[58] Field of Search ..... 224/259, 260, 224/262, 907, 646, 637, 628, 268

[56] References Cited

U.S. PATENT DOCUMENTS

| | | | |
|---|---|---|---|
| 2,271,136 | 1/1942 | Geiger | 224/907 |
| 2,651,441 | 9/1953 | Rau et al. | 224/259 |
| 4,776,504 | 10/1988 | Panth . | |

FOREIGN PATENT DOCUMENTS 4038096 6/1991 Germany .

*Primary Examiner*—Linda J. Sholl

*Attorney, Agent, or Firm*—Robert W. Becker & Associates

[57] ABSTRACT

A belt arrangement for carrying a hand-held working tool has a back plate for positioning on the back of the operator using the working tool. The back plate has an upper end and a lower end. Shoulder straps are connected to the upper end of the back plate. The shoulder straps have forward ends. A lateral strap is connected to the back plate and loops forwardly. The lateral strap has a forward end. A support plate for supporting the working tool is positioned opposite the lateral strap. The support plate has a support strap having a first end connected to the lateral strap. A hip belt is connected to the lower end of the back plate and has a first portion looping forwardly from the back plate and connected to the first end of the support strap. The forward end of the lateral strap, the forward ends of the shoulder straps, and a free end of the first portion of the hip belt are positioned separate from one another. A connecting strap for each one of the forward ends of the shoulder straps is provided. The connecting straps connect the shoulder straps to the lower end of the back plate.

10 Claims, 3 Drawing Sheets

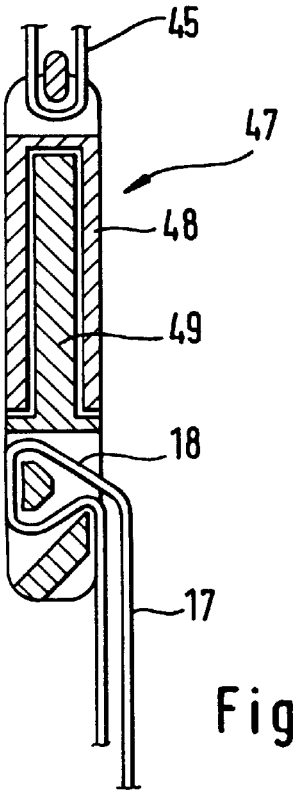
Fig. 4
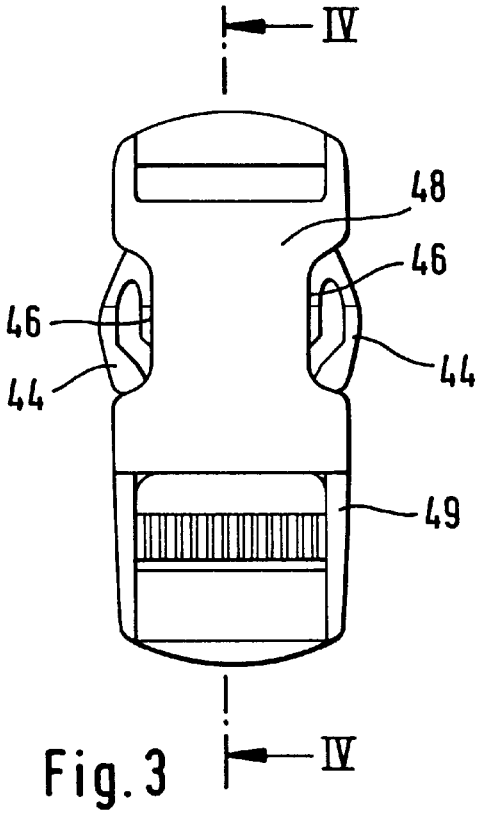
Fig. 3
Fig. 6
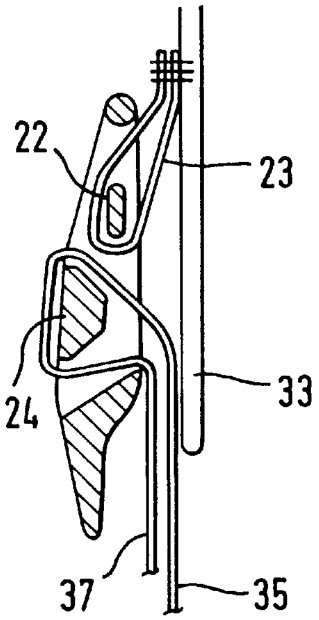
Fig. 5
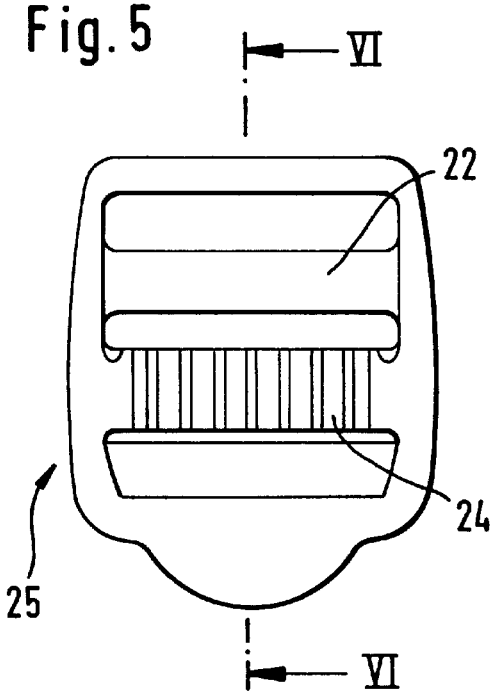

BELT ARRANGEMENT FOR CARRYING A HAND-HELD WORKING TOOL

BACKGROUND OF THE INVENTION

The present invention relates to a belt arrangement to be used by an operator for carrying a hand-held working tool, especially a trimmer etc. The belt arrangement comprises a back plate and shoulder straps connected thereto having free forward ends. A lateral strap extends from the back plate laterally to the front whereby the forward end of the lateral strap ends at the lower portion of the rib cage of the operator. A lateral support plate for the working tool is provided whereby the support plate is connected with a support strap to the back plate and the lateral strap.

From German Patent Application 40 38 096 a belt arrangement of the aforementioned kind for a grubbing or clearing saw is known. A closure plate for connecting the forward ends of the shoulder straps to the lateral strap is provided at the level of the sternum of the operator. The support strap of the support plate is connected to the closure plate. The disclosed belt arrangement ensures a secure and steady positioning but distributes the load of the tool, that is connected on one side to the support strap, non-uniformly onto the shoulders of the operator. Furthermore, the closure plate, designed to directly receive the forces and to distribute them into the shoulder straps is constrictive, because it presses onto the sternum and impedes breathing of the operator. This arrangement is especially unsuitable for female operators. Furthermore, when attaching the belt arrangement, it is difficult to secure it on the body because the closure plate is provided with a plurality of insertion openings that can be easily confused.

From U.S. Pat. No. 4,776,504 a support structure is known which is comprised of a U-shaped plastic plate whereby the legs of the U-shaped plate form the shoulder straps. The free ends of the legs must be connected across the sternum of the operator. The support strap of the support plate is fastened between one end of a shoulder strap and the back portion of the plastic plate. At the opposite side of the operator a compensation strap is provided. This allows for an almost uniform distribution of the load onto the shoulders. However, the compensation strap acts only on one side of the operator's body. Moreover, the chest area is constricted because of the shoulder straps connected at the level of the sternum. Female operators cannot use this known support device because of the disclosed belt arrangement.

It is therefore an object of the present invention to provide a belt arrangement for supporting a hand-held working tool such that in the chest area of the operator no uncomfortable loading results and a uniform load distribution onto the shoulders of the operator is possible.

SUMMARY OF THE INVENTION

A belt arrangement for carrying a hand-held working tool according to the present invention is primarily characterized by:

A back plate for positioning on the back of an operator using the working tool;

The back plate having an upper end and a lower end;

Shoulder straps connected to the upper end of the back plate;

The shoulder straps having forward ends;

A lateral strap connected to the back plate and looping forwardly;

The lateral strap having a forward end;

A support plate for supporting the working tool positioned opposite the lateral strap;

The support plate comprising a support strap, the support strap having a first end connected to the lateral strap;

A hip belt connected to the lower end of the back plate;

The hip belt having a first portion looping forwardly from the back plate and connected to the first end of the support strap;

The forward end of the lateral strap, the forward ends of the shoulder straps, and a free end of the first portion of the hip belt positioned separate from one another;

A connecting strap for each one of the forward ends of the shoulder straps, the connecting straps connecting the shoulder straps to the lower end of the back plate.

Advantageously, the belt arrangement further comprises a compensation strap connecting the forward end of the lateral strap and a free end of the first portion of the hip belt. A fastening member is slidably attached to the compensation strap, wherein the first end of the support strap is fastened to the fastening member.

Advantageously, the belt arrangement further comprises a coupling member, wherein the coupling member and the fastening member form a plug-in coupling. The first end of the support strap is length-adjustably connected to the coupling member and the coupling member is inserted into the fastening member for connecting the support strap to the compensation strap.

The support strap has a second end and the hip belt has a second portion extending from the back plate in a direction opposite to the first portion. The second end of the support strap is connected to the second portion of the hip belt.

The second end of the support strap comprises a length-adjusting member for adjusting the length of the support strap.

The support plate is position-adjustable by the support strap and is comprised of an elastic material.

Advantageously, each one of the connecting straps comprises a length-adjusting member for adjusting the length of the connecting straps, the members connected to the forward ends of the shoulder straps.

The lateral strap is connected to the upper end of the back plate and is vertically spaced from the second portion of the hip belt.

The belt arrangement may further comprise a load-bearing strap connected with a first end to the second portion of the hip belt and with a second end to a connecting location of the shoulder straps to the upper end of the back plate.

Advantageously, the back plate is elastic but sufficiently stiff to provide a support function for the belt arrangement. The shoulder straps, the hip belt, and the lateral strap are substantially torsion-resistant.

The hip belt is preferably adapted to receive a tool bag.

Since the free forward ends of the shoulder straps are separated from the forward end (first portion) of the hip belt and the forward end of the lateral strap, i.e., are not connected to other belt ends or strap ends of the belt arrangement, the chest area of the operator remains free. Breathing of the operator is thus not impaired because no forces are introduced within the chest area. The belt arrangement is thus especially suitable for female operators because it is possible to work with such a belt arrangement without being restricted in any way.

The hip belt, which is open in the direction toward the support plate, is loaded due to the connection to the support strap of the support plate by the weight forces of the working tool such that the hip belt rests solidly on the hop similar to a conventional belt so that a substantially uniform load-distribution across the hip area is achieved.

The forward ends of the shoulder straps are not connected with any other belt ends and strap ends, but are simply connected with connecting straps to the back plate. They are thus positioned on the body of the operator in the manner of the shoulder straps of a backpack. Putting on and removing the belt arrangement is thus especially simple.

Advantageously, the forward end of the lateral strap is connected to the forward end of the hip belt by a compensation strap to which is connected the support strap. With the aid of the compensation strap, a load distribution into the hip belt and into the lateral strap thus takes place whereby the load introduced into the lateral strap is transmitted into the back plate and onto the shoulder straps. Preferably, the compensation strap has connected thereto a fastening member that is adjustable or slidable in the longitudinal direction of the compensation strap. The support strap is connected to this fastening member. Thus, without manually adjusting or adapting the strap length, it can be automatically adjusted to the height and the body conformation of different operators. A corresponding adjusted load distribution is also achieved when the operator moves in various ways via the fastening member that is slidably connected to the compensation strap. Even for extended periods of use of the belt arrangement, an optimal load distribution onto the hip belt and the shoulder straps is thus ensured and maintained over the entire period of use.

Expediently, the fastening member is part of a plug-in connection (coupling) whereby the counter member is fastened to at the facing end of the support strap. The thus embodied belt lock is the only connection that needs to be detached (released) for putting on or removing the belt arrangement. The thus designed simple embodiment ensures that even first-time users can put on the belt arrangement without further instructions in the correct and functional position whereby the back plate determines the position of the belt arrangement. The individual belts or straps are connected torsion-resistant to the back plate so that the belt arrangement, even when removed from the operator's body, remains in a fixed position required for putting it on, an erroneous positioning on the body is prevented.

BRIEF DESCRIPTION OF THE DRAWINGS

The object and advantages of the present invention will appear more clearly from the following specification in conjunction with the accompanying drawings, in which:

FIG. 3 shows a schematic plan view onto the belt lock;

FIG. 4 shows a section along the line IV—IV of FIG. 3;

FIG. 5 is a schematic representation of a plan view onto the length-adjusting member for the support strap; and FIG. 6 is a section along the line VI—VI of FIG. 5.

DESCRIPTION OF PREFERRED EMBODIMENT

The present invention will now be explained in detail with the aid of a specific embodiment utilizing FIGS. 1 through 6.

Figure 1:
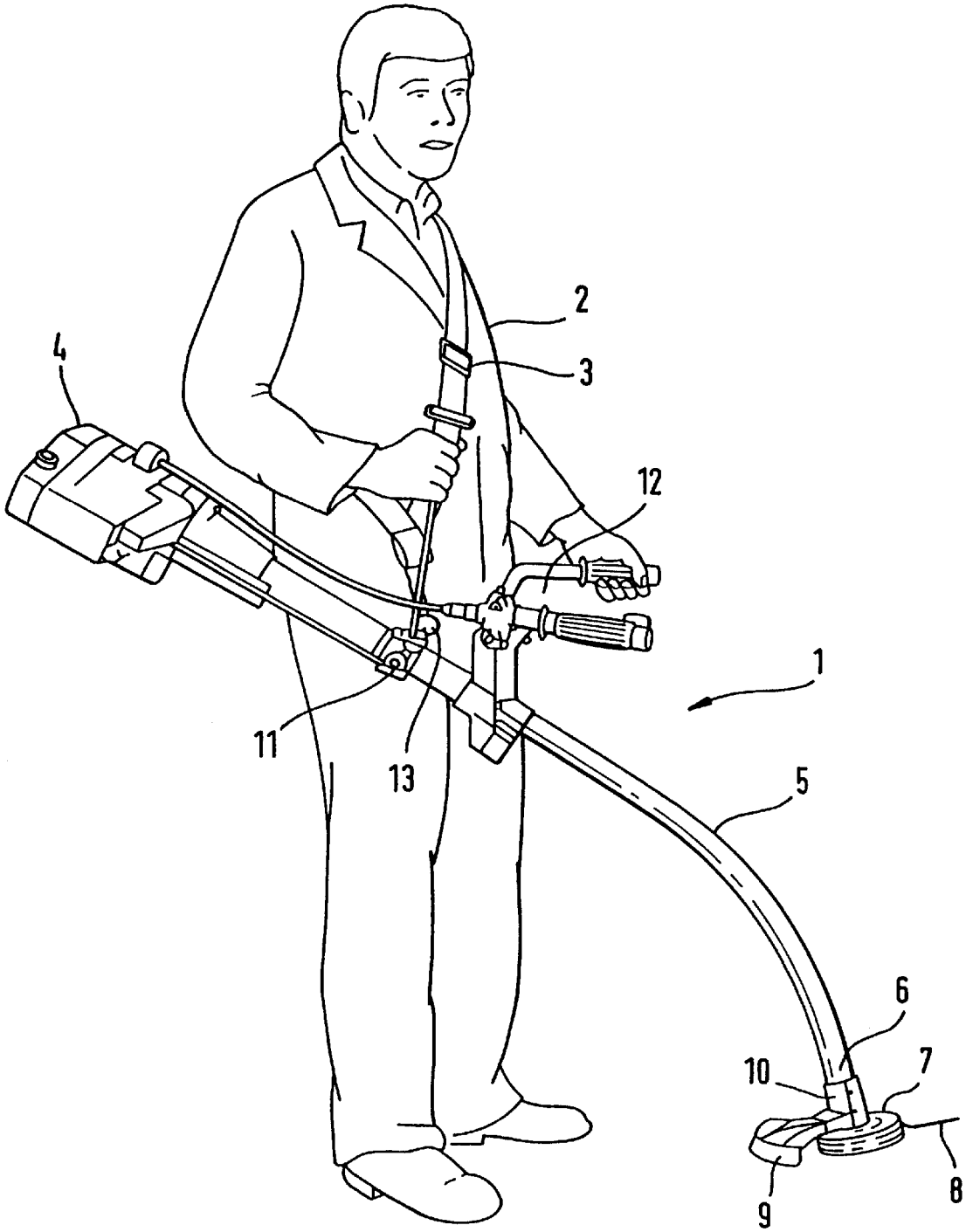
Fig. 1 PRIOR ART
FIG. 1 is a perspective representation of a known belt arrangement for use by an operator for carrying a working tool.

FIG. 1 shows a simple support belt arrangement 3 according to the prior art. The belt arrangement 3 is designed for carrying a working tool which in the shown embodiment is a trimmer 1. The support belt arrangement 3 is placed onto the left shoulder of the operator 2 and comprises at the right side of the operator suspending eye 13, carabine hooks etc. from which the working tool is suspended with a suspending device 11. The suspending device 11 is provided approximately at the center of gravity of the working tool 1.

The trimmer 1 comprises a drive motor 4 which in the shown embodiment is a combustion engine, e.g., a two-stroke engine. The drive motor 4 drives a drive shaft positioned in the curved guide tube 5 which drives the cutter head 7 at the lower end section 6 of the guide tube 5. In the shown embodiment the cutter head 7 is a thread cutter which has at least one radially extending thread section 8 which serves as a cutting tool of the cutter head 7. Instead of the thread section 8 it is also possible to provide a cutting blade, a circular saw blade etc. Above the cutter head 7 a protective shield is arranged which extends over part of the circumference and which is fastened with a sleeve 10 to the end section 6 of the guide tube 5. A handle bar-like grip 12 connected to the guide tube 5 serves for guiding the trimmer. Necessary operating elements for the drive motor 4 are arranged at this grip 12.

Figure 2:
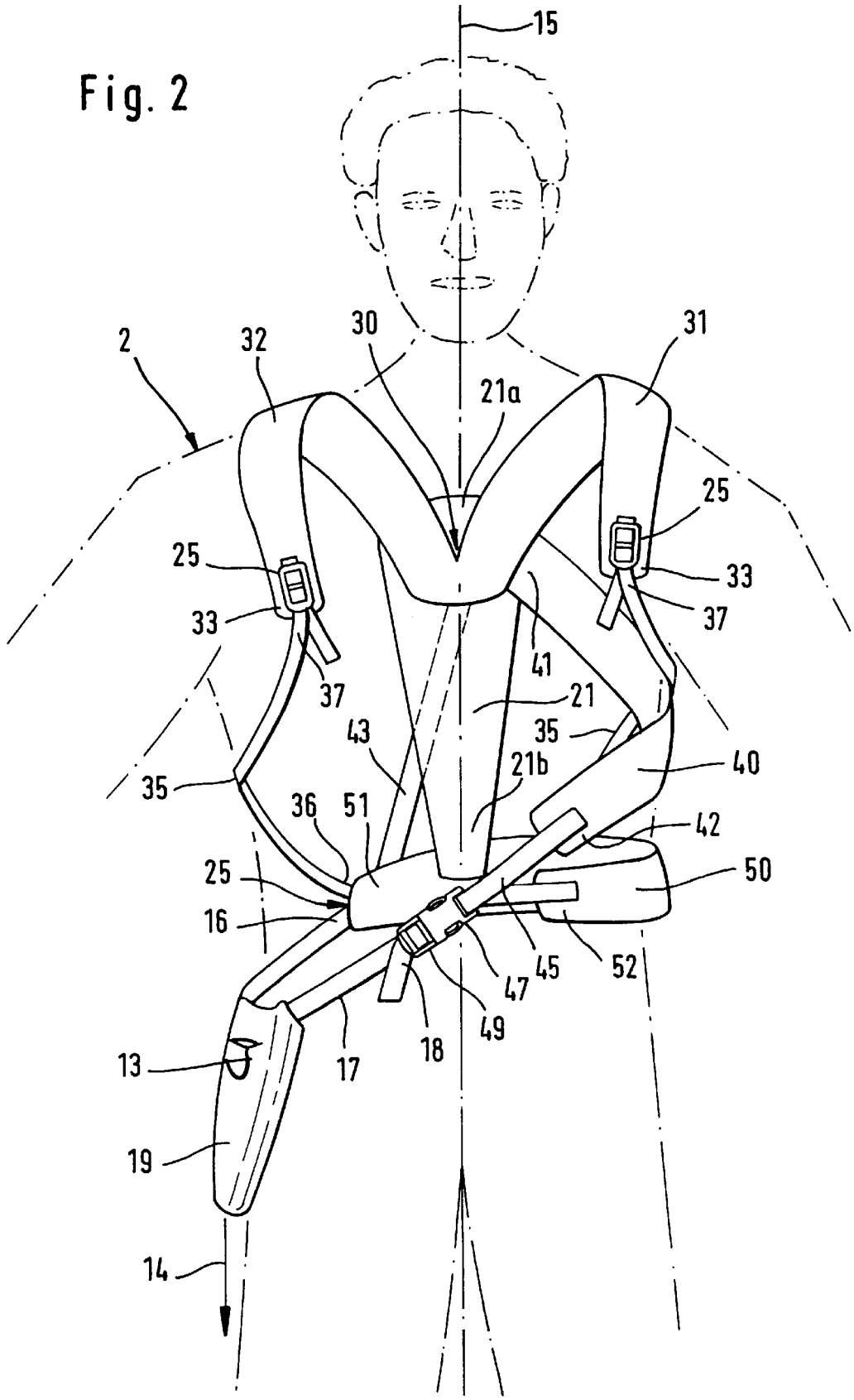
FIG. 2 shows in a schematic perspective representation the inventive belt arrangement for carrying a hand-held working tool.

For producing a symmetric load distribution onto the shoulders of the operator 2, the inventive belt arrangement 20 according to FIG. 2 is provided. The belt arrangement 20 is comprised of a back plate 21 which for the transmission of pushing forces is preferably made of plastic material, especially a somewhat soft plastic material. In the area of the shoulder blades of the operator 2 shoulder straps 31, 32 are fastened to the upper area 21*a* of the back plate 21. Within the connecting area 30 of the shoulder straps 31, 32 at the back plate 21, the rearward end 41 of a lateral strap 40 is secured which extends from the upper area 21*a* of the back plate 21 laterally at a slant downwardly in the forward direction. The forward end 42 of the lateral strap 40 ends in the lower area of the rib cage of the operator 2.

Below the lateral strap 40 a hip belt 50 is arranged which is open in the direction toward the support plate 19. In the area of its rearward (second) end 51, the hip belt 50 is secured within the lower portion 21*b* of the back plate 21. In the shown embodiment the back plate 21 tapers downwardly from the upper fastening area 21*a* in the direction of the vertical axis 15 of the operator 2 to the lower area 21*b*. The forward end (first portion) 52 of the hip belt 50 ends approximately below the rib cage of the operator 2. In the shown embodiment, the forward end 42 of the lateral belt 40 is positioned in the vicinity of the first portion 52 of the hip belt 50.

According to the present invention, the forward end 42 of the lateral strap 40 is connected to the forward end (first portion) 52 of the hip belt 50 by a compensation strap 45. The compensation strap 45 has a fixed, non-changeable length and is non-detachably connected, respectively, sewn, onto the end 42 of the lateral strap 40, respectively, the end (first portion) 52 of the hip belt 50.

One end 18 of the support strap 17 is connected to the compensation strap 45 such that it is length-adjustable. The support strap 17 with its central area is connected to the support plate 19 that is positioned laterally at the operator 2, and the other end 16 is connected to the second end or second portion 51 of the hip belt 50 so as to be length-adjustable. The support plate 19 could also be attached in a length-adjustable manner to the support strap 17 whereby the support strap 17 would be looped through the support plate 19. The operator 2 can thus position-adjust the support plate 19 in the shown embodiment by quick-adjustment of the ends 16 and 18 or, in the alternative, by sliding the support plate 19 along the support strap 17 into a suitable position. The support plate 19 is comprised of an elastic, especially a soft-elastic, material so that it can adapt to the shape of the thigh of the operator 2. The suspending eye 13 for the working tool, e.g., the cutter or trimmer 1 (see FIG. 1), is provided at the support plate 19.

The hip belt 50, which is open in the direction toward the support plate 19, is completed to a closed loop for force-transmission by the support strap 17 whereby the weight force of the working tool 1 acting in the direction of arrow 14 ensures a secure and first positioning of the hip belt 50 on the hip of the operator 2. The hip belt 50 is thus positioned similar to a continuous belt at the body of the operator 2 so that the load is uniformly distributed over the entire length.

The end 18 of the support strap 17 facing the compensation strap 45 is suspended from a fastening member 47 which is displaceable in the longitudinal direction of the compensation strap 45. The compensation strap 45 is looped with play through the fastening member 47. The fastening member 47 is preferably embodied as a plug-in connection or coupling that can be easily opened and can be easily snapped closed, as is represented in FIGS. 3 and 4. The member 48 which is longitudinally adjustably positioned at the compensation strap 45 is embodied as a plug-in connector or coupler whereby the counter member 49 is secured at the end 18 of the support strap 17. The support strap 17 is fastened at the counter member 49 so as to be length-adjustable. As shown in FIG. 2, the counter member 49 has lateral snap hooks 44 which snap into lateral openings 46 of the plug-in coupling. The plug-in lock is then closed. When the snap hooks 44 are laterally suppressed, they are freed from the openings 46 so that the support strap 17 can be detached from the compensation strap 45. The inventive belt arrangement is thus open and can be put on or removed. Opening and closing of the entire belt arrangement is possible simply by activating the plug-in coupling (fastening member) 47 because the free forward ends 33 of the shoulder straps 31 and 32 are separate from the free forward end (first portion) 52 of the hip belt 50 as well as from the forward end 42 of the lateral strap 40. Between the forward end 42 of the lateral strap 40 and the ends 33 of the shoulder straps 31, 32 there is thus no direct connection. There is also no direct connection between the forward end (first portion) 52 of the hip belt 50 and the forward ends 33 of the shoulder belts 31, 32. The forward ends 33 of the shoulder belts 31, 32 are thus connected only by the lateral connecting straps 35 with the back plate 21. In the shown embodiment the rearward ends 36 of the connecting straps 35 are fastened to the back plate 21 in the lower area 21*b*. Expediently, the ends 36 are secured in the vicinity of the back plate 21 at the hip belt 50. The other forward ends 37 of the connecting straps 35 are connected by a length-adjusting member 25 to the free forward ends 33 of the shoulder belts 31 and 32. The length-adjusting member 25 is represented in detail in FIGS. 5 and 6 and is comprised substantially of a buckle which is fastened with a fastening loop 23 to the end 33 of the shoulder straps 31, 32 in a securely attached manner. The loop 23 surrounds a stay 22 and is sewn with its end to the shoulder straps 31, 32.

The looped end 37 of the connecting strap 35 engages a clamping stay 24 so that the connecting strap 35 is connected in a simple manner in a longitudinally adjustable fashion to the shoulder straps 31, 32.

The end 16 of the support strap 17 is connected to the hip belt 50 by a respective length-adjusting member 25 in the vicinity of the lower area 21*b* of the back plate 21. The support strap 17 is thus length-adjustable at its end 16. Both ends 16 and 18 of the support strap 17 are thus length-adjustable so that an optimal adjustment to the height and body size of the operator 2 is possible.

In the shown embodiment, the support strap 17 with its end 16 facing the back plate 21 is connected to the second portion 51 of the hip belt 50. The length-adjusting member 25 can be directly fastened to the second portion 51 of the hip belt 50. The connection of the support strap 17 to the back plate 21 is thus realized via a section of the hip belt 50. In the shown embodiment, the second portion 51 of the hip belt 50 projects past the back plate 21 in the direction toward the support plate 19. In order to provide for an optimized load distribution between the rearward portion 51 of the hip belt 50 and the fastening area 30 of the shoulder belt 31, 32, a connecting load-distribution or load-bearing strap 43 of a fixed length is provided at the back plate 21. Preferably, the load distribution strap 43 is connected to the rear end 41 of the lateral strap 40, and the rear end 41 of the lateral strap 40 is expediently fastened to the connecting location 30 of the shoulder straps 31 and 32. The rearward part of the hip belt 50 and the rearward end 41 of the lateral belt 40 are spaced from one another in the direction of the vertical axis 15 of the operator and connected to the back plate 21.

A tool bag (not represented) may be connected to the hip belt 50 for which purpose a loop or carabine hook is arranged at the hip belt 50.

The inventive belt arrangement according to FIG. 2 is comprised exclusively of flexible and/or elastic parts so that the operator's freedom of movement is not impaired. Especially, the chest area of the operator remains free so that breathing is not impaired. The inventive belt arrangement provides sufficient comfort to a female operator whereby the laterally acting weight force of the working tool is uniformly distributed onto the shoulders. The shoulders, despite the non-symmetric force introduction, are symmetrically loaded.

Due to the arrangement of the connecting straps 35, one of the connecting straps 35 crosses the lateral strap 40 on the side of the operator 2 opposite the support plate 19. Expediently, the lateral strap 40 rests on the body of the operator 2 and the connecting strap 35 rests on the lateral strap 40.

The present invention is, of course, in no way restricted to the specific disclosure of the specification and drawings, but also encompasses any modifications within the scope of the appended claims.

What I claim is:

1. A belt arrangement for carrying a hand-held working tool, said belt arrangement comprising:

a back plate for positioning on the back of an operator using the working tool;

said back plate having an upper end and a lower end and a first and a second lateral sides:

shoulder straps connected to said upper end of said back plate;

said shoulder straps having forward ends;

a lateral strap connected to said first lateral side of said back plate and having a forward end remote from said back plate;

a support plate for supporting the working tool positioned opposite said lateral strap relative to said back plate;

said support plate comprising a support strap, said support strap having a first end and a second end, said first end connected to said lateral strap;

a hip belt connected to said lower end of said back plate;

said hip belt having a first portion connected to said first end of said support strap and a second portion connected to said second end of said support strap;

wherein said forward end of said lateral strap, said forward ends of said shoulder straps, and a free end of said first portion of said hip belt are spaced apart from one another when worn by the operator;

a connecting strap for each one of said forward ends of said shoulder straps, said connecting straps connecting said shoulder straps to said lower end of said back plate.

2. A belt arrangement according to claim 1, further comprising:

a compensation strap connecting said forward end of said lateral strap and a free end of said first portion of said hip belt;

a fastening member slidably attached to said compensation strap, wherein said first end of said support strap is fastened to said fastening member.

3. A belt arrangement according to claim 2, further comprising a coupling member, wherein said coupling member and said fastening member form a plug-in coupling, wherein said first end of said support strap is length-adjustably connected to said coupling member, and wherein said coupling member is inserted into said fastening member for connecting said support strap to said compensation strap.

4. A belt arrangement according to claim 1, wherein said second end of said support strap comprises a length-adjusting member for adjusting a length of said support strap.

5. A belt arrangement according to claim 1, wherein said support plate is position-adjustable by said support strap and is comprised of an elastic material.

6. A belt arrangement according to claim 1, wherein each one of said connecting straps comprises a length-adjusting member for adjusting a length of said connecting straps, said members connected to said forward ends of said shoulder straps.

7. A belt arrangement according to claim 1, wherein said lateral strap is connected to said upper end of said back plate and is vertically spaced from said second portion of said hip belt.

8. A belt arrangement according to claim 1, further comprising a load-bearing strap connected with a first end to said second portion of said hip belt and with a second end to a connecting location of said shoulder straps to said upper end of said back plate.

9. A belt arrangement according to claim 1, wherein said back plate is elastic but sufficiently stiff to provide a support function for said belt arrangement and wherein said shoulder straps, said hip belt, and said lateral strap are substantially torsion-resistant.

10. A belt arrangement according to claim 1, wherein said hip belt is adapted to receive a tool bag.

* * * * *